US007778558B2

(12) United States Patent
Uchida et al.

(10) Patent No.: US 7,778,558 B2
(45) Date of Patent: Aug. 17, 2010

(54) IMAGE FORMING APPARATUS CAPABLE OF CONTROLLING APPLICATION VOLTAGE TO ADHERING MEMBER

(75) Inventors: Michio Uchida, Susono (JP); Shoichi Zensai, Mishima (JP); Youhei Suzuki, Suntou-gun (JP); Keisuke Mitsuhashi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 423 days.

(21) Appl. No.: 11/940,759

(22) Filed: Nov. 15, 2007

(65) Prior Publication Data

US 2008/0124103 A1 May 29, 2008

(30) Foreign Application Priority Data

Nov. 24, 2006 (JP) ..... 2006-317849

(51) Int. Cl.
*G03G 15/00* (2006.01)

(52) U.S. Cl. ..... 399/45; 399/66; 399/303

(58) Field of Classification Search ..... 399/45, 399/66, 88, 303, 314
See application file for complete search history.

(56) References Cited

U.S. PATENT DOCUMENTS 6,477,339 B1 11/2002 Yano et al.
2009/0003895 A1* 1/2009 Yamauchi et al. ..... 399/313

FOREIGN PATENT DOCUMENTS

JP 07230223 A * 8/1995
JP 9-179419 A 7/1997
JP 10-333375 A 12/1998
JP 2001-209233 A 8/2001

* cited by examiner

*Primary Examiner*—David M Gray
*Assistant Examiner*—Barnabas T Fekete
(74) *Attorney, Agent, or Firm*—Fitzpatrick, Cella, Harper & Scinto

(57) ABSTRACT

The image forming apparatus, includes a conveyor belt for bearing a recording material, capable of suppressing an image blur caused by a separating discharge at the separation of the recording material from the conveyor belt. To fix record materials on a transportation belt, the recording material is charged by a adhering member to electrically adhere the recording material to the conveyor belt. When the recording material is separated from the conveyor belt, a separating discharge occurs between the recording material and the conveyor belt, as the recording material is charged. In order to reduce the faulty of the toner image on the recording material caused by the separating discharge, the voltage applied to the adhering member is controlled for example according to a current which the recording material receives at the transfer position to mutually cancel the charge received at the transfer position by the adhering member.

17 Claims, 7 Drawing Sheets

IMAGE FORMING APPARATUS CAPABLE OF CONTROLLING APPLICATION VOLTAGE TO ADHERING MEMBER

BACKGROUND OF THE INVENTION

1. Field of the Invention

The present invention relates to an image forming apparatus capable of transferring a toner image onto a recording material on a recording material conveying member that bears and bears the recording material.

2. Description of the Related Art

Recently, image forming apparatuses using an electrophotographic process are experiencing advancements toward higher speed, higher functions and color capability, and printers and copying machines of various types are commercially available. For example, an image forming apparatus of in-line type, in which image forming units a plurality of colors are arranged serially to execute multiple transfers of toner images in succession, is adopted as a color printer.

Within such image forming apparatus of an in-line type, there is known an image forming apparatus of this type that forms a full-color image by transferring toner images in succession from serially-arranged image forming units onto a belt-shaped intermediate transfer member. Then, the images on the intermediate transfer member are collectively transferred onto a recording material (sheet), for example borne on a belt-shaped conveying unit to form a recorded image. In another process, toner images are transferred in succession, from serially-arranged image forming units, directly onto a recording material borne on the surface of a conveyor belt in superposed manner to form a full-color image.

On the other hand, also known is an image forming apparatus in which, at the transfer of a toner image on a photosensitive member serving as an image bearing member or on an intermediate transfer member onto a recording material, the recording material is borne on a conveyor belt and conveyed to a transfer position. This process has an advantage that the behavior of the recording material is stabilized at the transfer position. In the case of bearing the recording material on the conveyor belt, an adhering member is utilized. The recording material is introduced between the conveyor belt and the adhering member, and a voltage is applied to the adhering member while the recording material passes a position opposed to the adhering member. Thus, the recording material is charged and electrically adhered to the conveyor belt, whereby the recording material can be fixed to the conveyor belt.

However, the recording material adhered to the conveyor belt as described above tends to cause, when separated from the conveyor belt, a separating discharge between the surface of the conveyor belt and the rear surface of the recording material. Therefore, in the case that a toner image is transferred onto the recording material borne on the conveyor belt, the toner image on the recording material is blurred by the influence of the separating discharge. In particular, blurring of the toner image by the separating discharge becomes conspicuous in a trailing edge portion in the moving direction of the recording material. This is because, in the course of separation of the recording material from the conveyor belt, the charge on the recording material may not lead to a discharge by being displaced on the recording material but loses a place of escapement, when the recording material is completely separated from the conveyor belt, thereby tending to cause a discharge. Also image blurring tends to be caused more conspicuously at the trailing edge of the recording material, because of instability in the separating direction.

Such image blurring is generated when a recording material, bearing an unfixed toner, is separated from the conveying member, and is generated not only in the image forming apparatus of intermediate transfer process utilizing an intermediate transfer belt and a conveyor belt, but also in the image forming apparatus of a direct transfer process described above.

SUMMARY OF THE INVENTION

An object of the present invention is to prevent an image defect that is generated by a separating discharge when the recording material is separated from the recording material is separated from the recording material conveying member.

Another object of the present invention is to provide an image forming apparatus including an image bearing member for bearing a toner image, a transfer member for electrically transferring the toner image from the image bearing member to a recording material at a transfer position, a recording material conveying member for bearing and conveying the recording material through the transfer position, an adhering member for charging the recording material at an adhering position upstream of the transfer position thereby electrically adhering the recording material to the recording material conveying member, a first power supply portion for supplying the adhering member with a voltage, a second power supply portion for supplying the transfer member with a voltage, and a controller for controlling the output of the first power supply portion, wherein, when a recording material is positioned astride the adhering position and the transfer position, the controller switches the output of the first power supply portion from a first output to a second output, and sets the second output based on a voltage-current relationship of the second power supply portion.

Still another object of the present invention is to provide an image forming apparatus including an image bearing member bearing a toner image, a transfer member for electrically transferring the toner image from the image bearing member to a recording material at a transfer position, a recording material conveying member for bearing the recording material from an upstream side to a downstream side of the transfer position and conveying it through the transfer position, an adhering member for charging the recording material at an adhering position upstream of the transfer position thereby electrically adhering the recording material to the recording material conveying member, a first power supply portion for supplying the adhering member with a voltage, a controller for controlling the output of the first power supply portion, a first mode of not forming the toner image at an edge portion of the recording material thereby forming a margin at the trailing edge of the recording material and a second mode of forming the toner image over to the trailing edge of the recording material, wherein the controller switches, in the case of executing the second mode, the output of the first power supply portion from a first output to a second output while the recording material passes the adhering position.

Still other objects and further features of the present invention will become apparent from the following description of exemplary embodiments with reference to the attached drawings.

DESCRIPTION OF THE EMBODIMENTS

In the following, exemplary embodiments of the present invention will be described in detail, with reference to the accompanying drawings. However, in the following embodiments, components described therein are to be suitably changed in dimension, material, shape and relative position thereof according to the constitution of the apparatus and conditions to which the present invention is to be applied. Therefore, the embodiments should not be construed as to restrict the scope of the invention thereto unless specified otherwise.

First Exemplary Embodiment

Entire Construction of Image Forming Apparatus

Figure 1:
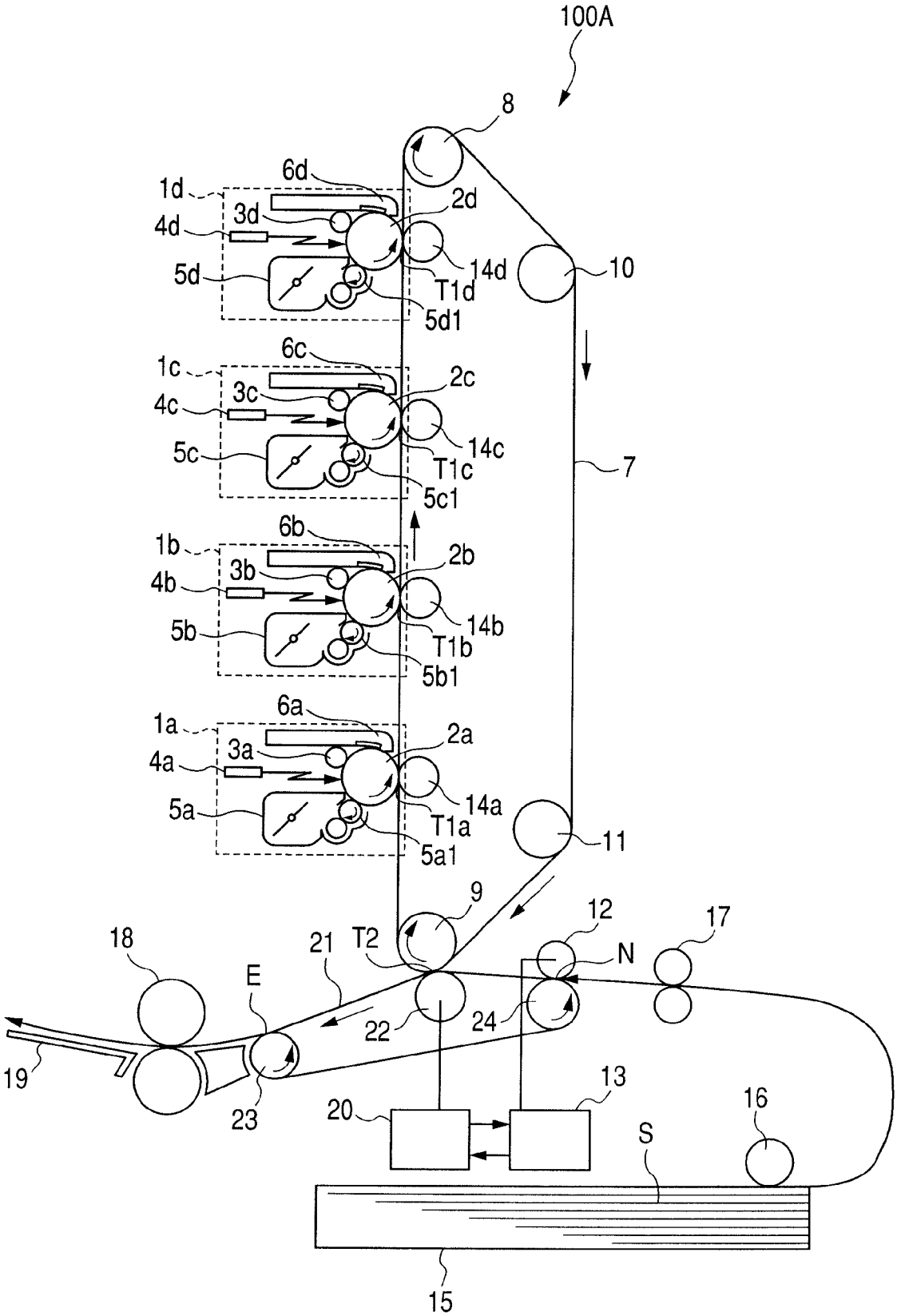
FIG. 1 is a schematic cross-sectional view of an image forming apparatus in an exemplary embodiment of the present invention.

At first described is the entire construction of an exemplary embodiment of the image forming apparatus of the present invention. FIG. 1 schematically illustrates the construction of an image forming apparatus 100A of the present exemplary embodiment.

The image forming apparatus 100A of the present exemplary embodiment is a full-color image forming apparatus utilizing an electrophotographic process of an intermediate transfer type and in-line type. The image forming apparatus 100A includes, as a plurality of image forming units, first to fourth process stations 1*a*-1*d*, which are four image forming units different in the colors of respectively formed images and are arranged substantially linearly along a substantially vertical direction. In the drawings, suffixes a, b, c and d in connection with the reference numerals relate to components having the same or corresponding function or construction and indicate that the components are provided for respective colors.

The process stations 1*a*-1*d* respectively include cylindrical electrophotographic photosensitive members (photosensitive drums) 2*a*-2*d* serving as first image bearing members. Along the peripheries of the photosensitive drums 2*a*-2*d*, there are disposed charging rollers 3*a*-3*d* serving as charging units for uniformly charging the photosensitive drums 2*a*-2*d*, and exposure devices 4*a*-4*d* as optical units for irradiating the photosensitive drums 2*a*-2*d* with laser lights to form electrostatic images (latent images). Also along the peripheries of the photosensitive drums 2*a*-2*d*, there are disposed developing devices 5*a*-5*d* serving as developing units for developing the electrostatic images with toners of respectively magenta, cyan, yellow and black colors to obtain visible images. Furthermore, along the peripheries of the photosensitive drums 2*a*-2*d*, there are disposed cleaning apparatuses 6*a*-6*d* serving as cleaning units for eliminating the toner (residual toner) remaining on the photosensitive drums 2*a*-2*d* after a transfer step.

Developing rollers 5*a*1-5*d*1 as developer bearing members contained in the developing devices 5*a*-5*d* are supported by frame members constituting the developing devices 5*a*-5*d*, with a predetermined gap to the opposed photosensitive drums 2*a*-2*d*. At the developing operation, a developing bias is applied to the developing rollers 5*a*1-5*d*1. In the present exemplary embodiment, the charging polarity of the photosensitive drums 2*a*-2*d* is negative. Also in the present exemplary embodiment, the normal charging polarity of the toners is negative. In the present exemplary embodiment, the development of the electrostatic image is executed by a reversal developing method, in which a toner charging using the same polarity as the charging polarity of the photosensitive drums 2*a*-2*d* is deposited to an image area (exposed area) of the photosensitive drums 2*a*-2*d* where the charge is attenuated by an exposure.

Along the process stations 1*a*-1*d*, disposed is an intermediate transfer belt 7, constituted of an endless belt and constituting an intermediate transfer member serving as a second image bearing member. The intermediate transfer belt 7 is supported under tension by, as a plurality of support members, an intermediate transfer belt driving roller 8, an idler roller 9, and tension rollers 10, 11. By a rotary driving power transmitted from an unillustrated drive unit (driving source) to the intermediate transfer belt driving roller 8, the intermediate transfer belt 7 is rotated (circulatory displacement) in a direction indicated by an arrow. The intermediate transfer belt 7 is so positioned as to be in contact with the photosensitive drums 2*a*-2*d* of the process stations 1*a*-1*d*.

On the internal surface side of the intermediate transfer belt 7, in positions respectively opposed to the photosensitive drums 2*a*-2*d*, disposed are primary transfer rollers 14*a*-14*d* which are rotary members serving as primary transfer members. The primary transfer rollers 14*a*-14*d* are pressed respectively to the photosensitive drums 2*a*-2*d* across the intermediate transfer belt 7. Thus, nips (primary transfer nips) are formed in primary transfer portions T1*a*-T1*d*, which are contact portions between the intermediate transfer belt 7 and the photosensitive drums 2*a*-2*d*. In the present exemplary embodiment, the primary transfer rollers 14*a*-14*d* are independently connected to a primary transfer bias source (not illustrated) which is a constant-voltage power source serving as a bias output unit. In the present exemplary embodiment, at a primary transfer step, a primary transfer bias, that is output from the primary transfer bias source, is controlled at a constant voltage and has a polarity opposite to the normal charging polarity of the toner, and is applied to the primary transfer rollers 14*a*-14*d*. Thus, in the primary transfer portions T1*a*-T1*d*, an electric field is formed in such a direction that the toner charged in the normal charging polarity moves from the photosensitive drums 2*a*-2*d* to the side of the intermediate transfer belt 7. Therefore, by the application of the primary transfer bias to the primary transfer rollers 14*a*-14*d*, the toner images of the respective colors on the photosensitive drums 2*a*-2*d* are transferred (primary transfer) onto the intermediate transfer belt 7.

A conveyor belt 21 formed by an endless belt, serving as a recording material bearing member (recording material bearing/conveying member) for bearing and conveying a recording material S, is disposed in contact with the intermediate transfer belt 7. The conveyor belt 21 is supported under tension by, as a plurality of support members, a conveyor belt driving roller 23, an idler roller 24, and a secondary transfer roller 22 which is a rotary member serving as a secondary transfer position member. By a rotary driving power transmitted from an unillustrated drive unit (driving source) to the conveyor belt driving roller 23, the conveyor belt 21 is rotated (circulatory displacement) in a direction indicated by an arrow. The conveyor belt 21 is so positioned as to be in contact with the intermediate transfer belt 7, and conveys the recording material S, supported thereon, so as to be in contact with the intermediate transfer belt 7.

As the material constituting the conveyor belt 21, a dielectric resin such as polyethylene terephthalate resin (PET resin), polyvinylidene fluoride resin (PVdF resin), polyurethane resin or polyimide resin can be employed advantageously. In the present exemplary embodiment, the conveyor belt 21 advantageously has a volume resistivity of from $1\times10^{5}$ to $1\times10^{12}$ Ω·cm. The present exemplary embodiment employed, as the conveyor belt 21, an endless belt based on a PVdF resin and having a volume resistivity of $1\times10^{8}$ Ω·cm.

The secondary transfer roller 22 is contacted, across the conveyor belt 21 and under a prescribed pressure, with the idler roller 9 which is one of the rollers supporting the intermediate transfer belt 7 under tension. This nip (secondary transfer nip) is formed in a secondary transfer position T2 which is a contact portion between the intermediate transfer belt 7 and the conveyor belt 21. In the secondary transfer position T2, a bias is applied to the recording material S on the conveyor belt 21 through the secondary transfer roller 22. In the present exemplary embodiment, the secondary transfer roller 22 is connected to a secondary transfer bias source 20 which is a constant voltage power source serving as a bias output unit. Also in the present exemplary embodiment, the idler roller 9 is electrically grounded. In the present exemplary embodiment, at a secondary transfer step, a secondary transfer bias, that is output from the secondary transfer bias source 20, is controlled at a constant voltage and has a polarity opposite to the normal charging polarity of the toner, is applied to the secondary transfer roller 22. Thus, in the secondary transfer position T2, an electric field is formed in such a direction that the toner charged in the normal charging polarity moves from the intermediate transfer belt 7 to the side of the conveyor belt 21. Therefore, by the application of the secondary transfer bias to the secondary transfer roller 22, the toner images on the intermediate transfer belt 7 are transferred (secondary transfer) onto the recording material S borne on the conveyor belt 21.

As the secondary transfer roller 22, employed was a roller prepared by forming, on a metal core, an elastic member prepared by blending an epichlorhydrin rubber, regulated at a volume resistivity of $1\times10^{7}$ Ω·cm, and an NBR rubber. The primary transfer roller and the transfer roller to be described later have a substantially similar construction.

On the surface of the conveyor belt 21, at the upstream side of the secondary transfer position T2 in the conveying direction of the recording material S, an adherence roller 12, which is a rotary member serving as an adherence member, is contacted in a state opposed to the idler roller 24. Thus, a nip (adherence nip) is formed in an adherence position N which is a contact portion of the adherence roller 12 and the conveyor belt 21. In the adherence position N, a bias is applied to the recording material S on the conveyor belt 21, through the adherence roller 12. The adherence roller 12 pinches the recording material, passing the adherence position N, in cooperation with the conveyor belt 21. In the present exemplary embodiment, the adherence roller 12 is connected to an adherence bias source 13 which is a constant current power source serving as a bias output unit. Also in the present exemplary embodiment, the idler roller 24 is electrically grounded. In the present exemplary embodiment, at an adherence step of adhering the recording material S to the conveyor belt 21, an adherence bias (constant current bias), that is output from the adherence bias source 13, is controlled at a constant current and has a polarity which is the same as that of the secondary transfer bias (namely opposite to the normal charging polarity of the toner) is applied. Thus, the recording material S is charged by an electric field formed between the adherence roller 12 and the conveyor belt 21. In this manner the recording material S is conveyed, under electrical adherence, by the conveyor belt 21.

As the adherence roller 12, employed was a solid rubber roller of a diameter of 12 mm, prepared by an EPDM rubber in which carbon black was dispersed for regulating the resistance. The adherence roller 12 is so constructed that the bias can be applied to a metal core. The electrical resistance of the adherence roller 12 was regulated to an electrical resistance of $1\times10^{6}$Ω, when measured in a state where the external periphery of the roller is wound with a metal foil of a width of 1 cm and a voltage of 500V is applied between the same and the metal core.

In the present exemplary embodiment, at the adherence position N, the roller contacting the external periphery of the conveyor belt 21 is provided with a bias, and the roller contacting the internal periphery of the conveyor belt 21 is electrically grounded. It is however also possible, in the contrary, to provide an adherence bias to the roller contacting the internal periphery of the conveyor belt 21, and to electrically ground the roller contacting the external periphery of the conveyor belt 21. In such a case, the polarity of the applied adherence bias becomes opposite to that in the afore-mentioned case. In any case, the electric field generated by the adherence bias is in an opposite direction to that of the electric field at the secondary transfer position. Also the adherence bias may be applied, instead of the adherence member in contact with the conveyor belt 21, to an adherence member disposed not in contact with the conveyor belt 21, such as a corona charger. The same applies to the secondary transfer roller 22 and the idler roller 9 at the secondary transfer position T2.

The recording material S is stored in a stacked state in a feed unit 15, provided in a lower part of the image forming apparatus 100A, as illustrated in FIG. 1, and is separated and fed one-by-one by a feed roller 16 constituting a feeding unit, and conveyed to registration rollers 17 in pair. The paired registration rollers 17 advance the recording material S onto the conveyor belt 21, in synchronization with an image on the intermediate transfer belt 7.

The recording material S, having received the transferred toner image at the secondary transfer position T2, is separated from the conveyor belt 21 at a separating portion E which is positioned above a drive roller 23 at the downstream side of the secondary transfer position T2 in the conveying direction of the recording material S, and is conveyed to a fixing device 18 serving as a fixing unit.

Then, the recording material S, after an image fixation by applications of heat and pressure in the fixing device 18, is discharged to a discharge tray 19, which is exposed at the exterior of the image forming apparatus 100A.

For example, in the case of a full-color image formation, at first in the first process station 1*a*, the photosensitive drum 2*a* is uniformly charged by the charging roller 3*a*, and the charged surface of the photosensitive drum 2*a* is scan exposed by the exposure device 4*a* according the image information of a corresponding color component. The electrostatic image, thus formed on the photosensitive drum 2*a*, is developed by the developing device 5*a* as a toner image. The toner image, formed on the photosensitive drum 2*a*, is transferred (primary transfer) at the primary transfer portion T1*a*, onto the intermediate transfer belt 7.

In succession, in the second to fourth process stations 1*b*-1*d*, toner images are formed on the photosensitive drums 2*b*-2*d* in the same manner as in the first process station 1*a*. Then, the toner images are transferred (primary transfer) in succession at the respective primary transfer portions T1*b*-T1*d*, from the respective photosensitive drums 2*b*-2*d* onto the intermediate transfer belt 7, so as to be superposed with the toner image already formed on the intermediate transfer belt 7.

The recording material S is borne on the conveyor belt 21 at the adherence position N, and then conveyed to the secondary transfer position T2, in synchronization with a timing that the leading end of the toner images on the intermediate transfer belt 7 is moved to the secondary transfer position T2. Then, at the secondary transfer position T2, the toner images on the intermediate transfer belt 7 are collectively transferred (secondary transfer) onto the recording material S.

The recording material S, having the transferred toner images, is conveyed to the fixing device 18. The fixing device 18 heats and pressurizes the toner images in a fixing portion (fixing nip) between a fixing roller and a pressure roller, for fixation onto the surface of the recording material S. Subsequently, the recording material S is discharged onto the discharge tray 19, whereby the image forming operations of a cycle are completed.

The toner remaining on the photosensitive drums 2*a*-2*d* after the primary transfer step are removed and recovered by cleaning apparatuses 6*a*-6*d*. Also, the toner remaining on the surface of the intermediate transfer belt 7 after the secondary transfer step may be removed and recovered by a belt cleaner (not illustrated) serving as a belt cleaning unit. Otherwise, the toner on the intermediate transfer belt 7 may be electrically transferred onto at least one of the photosensitive drums 2*a*-2*d* and removed and recovered by the cleaning apparatuses 6*a*-6*d* of the photosensitive drums 2*a*-2*d*.

The image forming apparatus 100A is also capable of a monochromatic or multi-color image by forming a toner image by a desired single process station or by certain of the four process stations. Also in such case, the image forming operations are similar to those in the full-color image formation described above, except that the toner image is not formed in certain of the process stations.

Figure 2A:
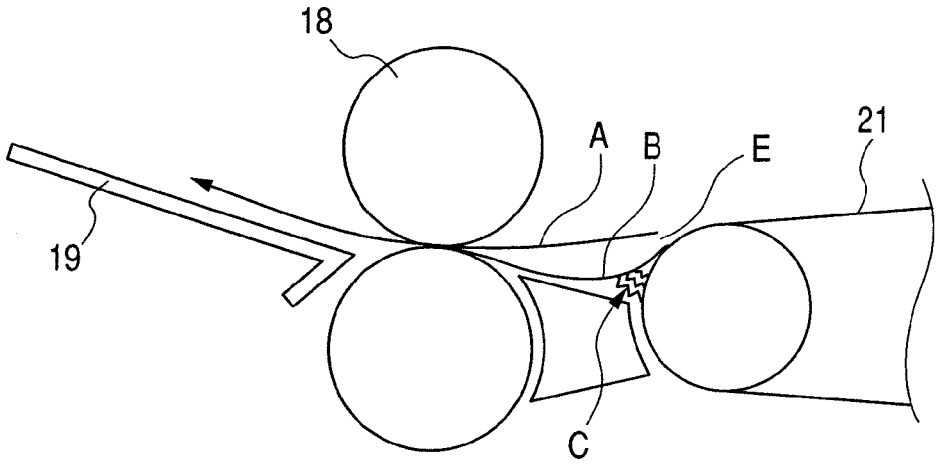
FIGS. 2A, 2B and 2C are schematic views illustrating a mode of conveyance of a recording material borne on a conveyor belt, and an image defect caused by a separating discharge.
Figure 2B:
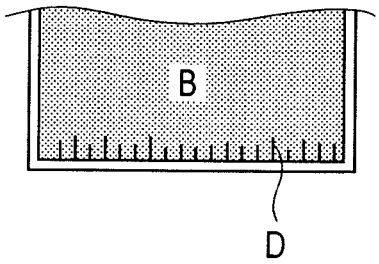
Figure 2C:
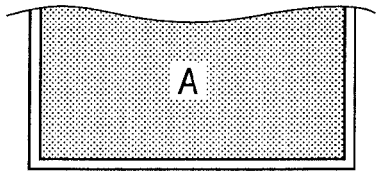

FIGS. 2A, 2B and 2C schematically illustrate a behavior of the trailing end in the moving direction of the recording material S, at the separation of the recording material S from the conveyor belt 21.

In the image forming apparatus 100A of the afore-mentioned construction, the recording material S can be firmly adhered to the conveyor belt 21 and the conveying performance can be improved by applying an adherence bias (for example 20 μA) to the adherence roller 12.

However, in the recording material S electrically adhered firmly to the conveyor belt 21, the trailing end thereof in the moving direction assumes, at the separation from the conveyor belt 21, a state as indicated by a symbol B in FIG. 2A. Also a separating discharge, as indicated by a symbol C in FIG. 2A, occurs between the surface of the conveyor belt 21 and the rear surface of the recording material S (surface opposite to the toner image bearing surface and in contact with the conveyor belt 21). Therefore, the transferred image may cause a blur D as schematically illustrated in FIG. 2B.

A principal object of the present exemplary embodiment is to suppress, in an image forming apparatus utilizing a recording material bearing member, an image blur caused by a separating discharge at the separation of the recording material from the recording material bearing member.

According to the present exemplary embodiment, the adherence bias is changed within a predetermined range at the trailing end in the moving direction of the recording material, in response to the transfer bias, whereby the adherence force to the recording material bearing member is so controlled as to be electrically reduced within a predetermined range at the trailing end in the moving direction of the recording material.

In the present exemplary embodiment, a transfer current actually flowing in the transfer portion at the transfer step is predicted from the target value of the transfer bias, and, in response to the result thereof, the adherence bias is changed within a predetermined range at the trailing end in the moving direction of the recording material.

The target value of the transfer bias is changed, in order to obtain a desired transfer ability, for example according to at least one of the type information of the recording material, the information on electrical resistance of the recording material, and the environmental information of the image forming apparatus. In a preferable exemplary embodiment, at least the information on the electrical resistance of the recording material is detected in the image forming apparatus. The information on the electrical resistance of the recording material can be detected from the output of the bias output unit, that outputs a bias to be applied to the recording material, at a detecting position. More specifically, in a state where the recording material is present at least in the detecting position, and where the bias output unit outputs a bias under a constant-voltage control or a constant-current control, the output voltage or the output current of the bias output unit is detected. As the bias application unit for applying a bias to the recording material at the detecting position, the adherence member for adhering the recording material to the recording material bearing member may be utilized.

Thus, in an exemplary embodiment of the present invention, the image forming apparatus includes a transfer bias changing unit for changing the transfer bias which the transfer bias output unit outputs for the transfer operation, and an adherence bias changing unit for changing the adherence bias which the adherence bias output unit outputs for the adhering operation.

The adherence bias changing unit makes a difference between a first value of the adherence bias when the leading end in the moving direction of the recording material passes the adherence portion and a second value of the adherence bias when the trailing end in the moving direction of the recording material passes the adherence portion, according to the value of the transfer bias in the transfer step to such recording material.

The transfer bias changing unit can change the transfer bias, according to the information relating to the electrical resistance of the recording material. Also the image forming apparatus may include an environment detection unit for detecting environmental information, at least including humidity information, and the transfer bias changing unit may change the transfer bias according to the detection result of the environment detection unit. Furthermore, the transfer bias changing unit may change the transfer bias according to the detection result of the environment detection unit and the information relating to the electrical resistance of the recording material.

In the image forming apparatus of an exemplary embodiment, the adherence bias output unit includes a detection unit for detecting an output voltage or an output current of the adherence bias output unit, when the adherence bias output unit outputs a bias under a constant-voltage or constant-current control. The transfer bias changing unit may change the transfer bias to the recording material, according to the output voltage or current detected by the detection unit when the recording material passes through the adherence portion. In more detail, the transfer bias changing unit changes, according to the detection result when a bias same as the first adherence bias is output and when the recording material passes the adherence portion, the transfer bias in the transfer step for such recording material. Also in such case, it is naturally possible to change the transfer bias in consideration of other information such as the environmental information pertaining to the environment of the apparatus. The adherence bias measuring unit can detect the information relating to the electrical resistance (impedance) of the recording material from a voltage-current relationship when the bias is applied by the adherence member to the recording material. The transfer bias can be changed based on the measurement result of the voltage-current relationship, or naturally can be changed by calculating the electrical resistance itself of the recording material from such measurement result and based on the result of such calculation.

Also in an exemplary embodiment of the present invention, the adherence bias changing unit makes a difference between the first value and the second value of the adherence bias according to the transfer bias at the transfer step, or more specifically according to the output current value, namely the transfer current, of the transfer bias output unit predicted from the target value. Also in another exemplary embodiment of the present invention, there is provided a measuring unit for measuring the output current of the transfer bias output unit when the transfer bias output unit outputs the afore-mentioned transfer bias. Then, the adherence bias changing unit makes a difference between the first value and second values of the adherence bias according to the output current measured by the measuring unit, while the recording material passes the transfer portion and is subjected to the transfer operation. More specifically, the output current is measured by the measuring unit while the adherence bias output unit outputs the adherence bias of the first value and while a part of the recording material that has passed the adherence portion is passing through the transfer portion and is subjected to a transfer operation. Then, the adherence bias changing unit changes, according to the measured output current, the second adherence bias for such recording material to a value different from the first adherence bias for such recording material.

Figure 4:
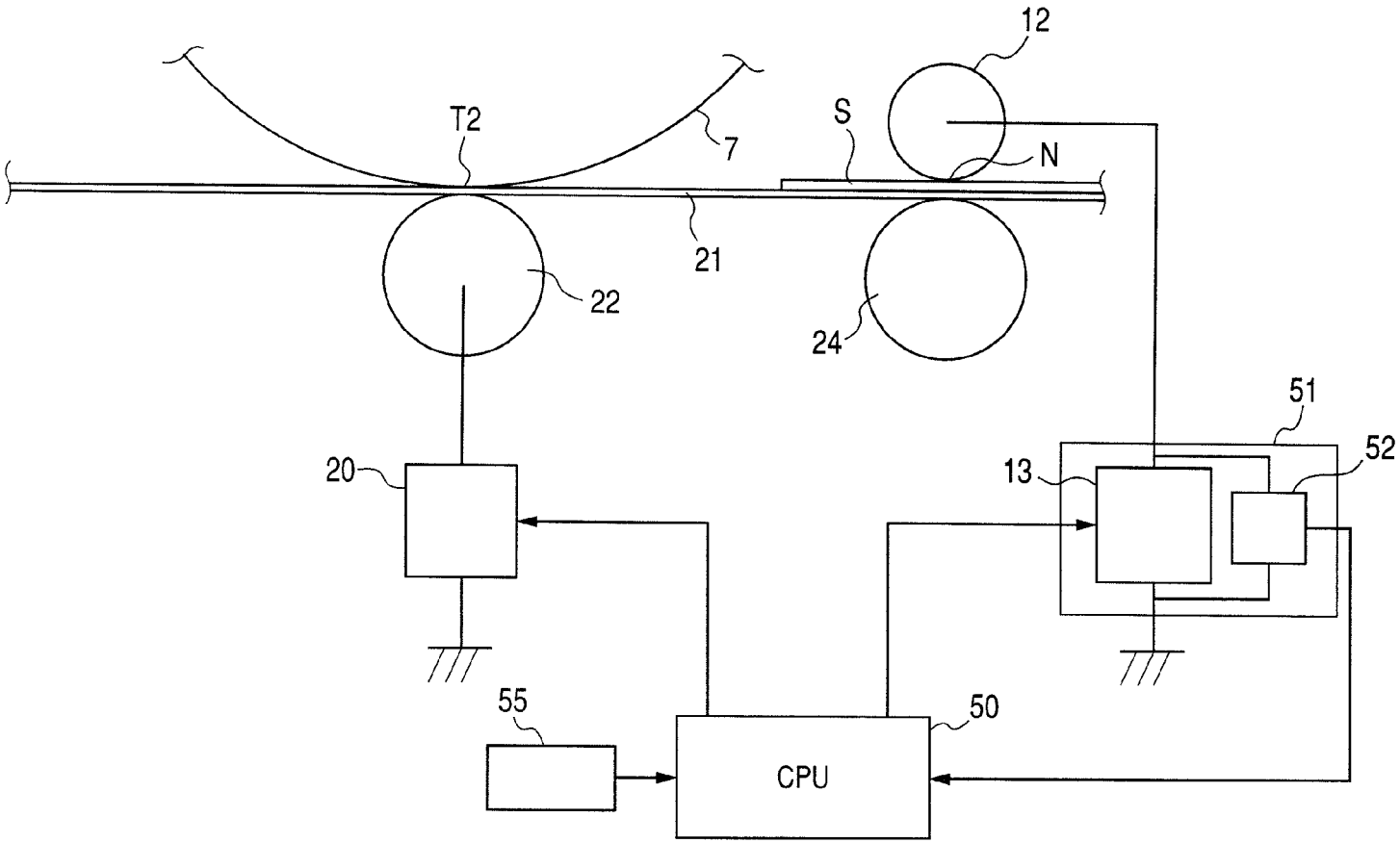
FIG. 4 is a block diagram illustrating an exemplary embodiment of a control in an adhering unit and a transfer unit.

In the following, a more detailed description will be given with reference also to FIG. 4. In the present exemplary embodiment, at least until the recording material S enters the adherence position N, the adherence bias source 13 starts to apply a bias of a predetermined value (first adherence bias) to the adherence roller 12. Thus, the recording material S is adhered to the conveyor belt 21, and the voltage-current relationship, while the adherence bias source 13 output the aforementioned bias, is detected as the information on the electrical resistance of the recording material S. In the present exemplary embodiment, the output voltage of the adherence bias source 13 is detected particularly when the adherence bias source 13 outputs a bias under a constant-current control. This, in the present exemplary embodiment, the adherence roller 12 functions as the adherence member and also as the detection unit for detecting the information on the electrical resistance of the recording material S.

Then, based on the afore-mentioned detection result of the information on the electrical resistance of the recording material S, a target value is determined for the secondary transfer bias to be applied from the secondary transfer bias source 20 to the secondary transfer roller 22 in the secondary transfer step at the secondary transfer position T2. Also based on thus determined target value of the secondary transfer bias, the transfer current actually flowing in the secondary transfer step, namely the output current of the secondary transfer bias source 20 when it output the secondary transfer bias, is predicted.

Then, based on the result of prediction for the transfer current, an adherence bias (second adherence bias), to be applied at the adherence position N to the predetermined range in the trailing end in the moving direction of the recording material S is determined.

Then, in synchronization with the timing that the portion of the predetermined range in the trailing end in the moving direction of the recording material S enters the adherence position N, the bias applied to the adherence roller 12 is changed from the first adherence bias, that has been applied to this timing, to the second adherence bias that is determined as described above.

In the present exemplary embodiment, the adherence bias source apparatus 51 is equipped with an adherence bias source (bias output portion) 13 as a bias output unit for outputting the bias to the adherence roller 12. Also the adherence bias source apparatus 51 is equipped, as a detection unit for detecting the output voltage or the output current when the adherence bias source 13 outputs a bias under a constant-current control or a constant-voltage control, with a voltage detection portion (voltometer) 52 for measuring the output voltage particularly when a constant current bias is output. The voltage detection portion 52 measures a voltage generated between the input and output terminals of the adherence bias source 13. The voltage detection portion 52 outputs an electrical signal, indicating the result of measurement, to a CPU 50 serving as a control unit.

The CPU 50 determines the target value of the secondary transfer bias, based on the signal indicating the measured result and supplied from the voltage detection portion 52, namely based on the information of the voltage output from the adherence bias source 13 in order to obtain a predetermined current. The CPU 50 may independently determine the electrical resistance itself of the recording material S and may determine the target value of the secondary transfer bias based thereon.

Also in the present exemplary embodiment, an environmental temperature-humidity sensor 55 for detecting the temperature and the humidity in the main body of the image forming apparatus is provided in the main body of the image forming apparatus, as an environment detection unit for detecting the environmental information, including at least the humidity information. An electrical signal indicating the detection result of the temperature-humidity sensor 55 is supplied to the CPU 50. In the present exemplary embodiment, the CPU 50 calculates an absolute humidity from the detection result of the temperature-humidity sensor 55, and determines the target value of the secondary transfer bias in consideration of the result of such calculation. Further, the CPU 50 receives an information input from an operation unit provided in the main body of the image forming apparatus or an operation unit of an external equipment, such as a personal computer, connected electrically to, i.e., in communication with, the main body of the image forming apparatus. Thus, at least information relating to the type of the recording material S to be used for image formation is entered into the CPU 50. In the present exemplary embodiment, the CPU 50 determines the target value of the secondary transfer bias also in consideration of such type information of the recording material S.

For example, in the case of detecting the output voltage when the adherence bias source outputs a bias under a constant-current control, as in the present exemplary embodiment, the detected voltage may be increased linearly or nonlinearly according to a predetermined calculation formula to obtain a transfer bias. The calculation formula may be made different or may be variable according to the environmental information and/or the type of the recording material S. Information on the calculation formula and table data to be used in such calculation is stored in advance in a ROM, as a memory unit incorporated in the CPU 50 or connected electrically to the CPU 50.

In the present exemplary embodiment, the adherence roller 12 and the adherence bias source 13 constitute an apparatus for detecting information relating to the electrical resistance of the recording material S. In the present exemplary embodiment, the CPU 50, serving as a control unit (controller) for comprehensively controlling the image forming apparatus 100A to execute sequential operations, also has a function as the transfer bias changing unit. Furthermore in the present exemplary embodiment, the CPU 50 further has a function of the adherence bias changing unit. The transfer bias changing unit and the adherence bias changing unit may naturally be provided as individual controllers.

In the present exemplary embodiment, the recording material S conveyed to the adherence position N, where a nip is formed between the conveyor belt 21 and the adherence roller 12, is sufficiently adhered to the conveyor belt 21 by the adherence bias, supplied from the adherence bias source 13, which is a constant-current source, to the adherence roller 12. The recording material S, thus sufficiently adhered to the conveyor belt 21, is conveyed to the secondary transfer position T2. The adherence bias in this state (first adherence bias) has a current amount sufficient for preventing the lifting of the recording material S from the conveyor belt 21, and enabling measuring the information on the electrical resistance of the recording material S, from the voltage and the current at the supply of such adherence bias. Such current amount is preferably from 10 μA to 40 μA. A current smaller than this range may be unable to adhere the recording material S sufficiently to the conveyor belt 21, and a current larger than this range may increase an escape current other than the current to the recording material S, and may deteriorate the detecting precision of the resistance of the recording material S. In the present exemplary embodiment, it was selected as 20 μA. Then, an electrical signal indicating the measured result of the output current of the adherence bias source 13 is supplied to the CPU 50, and is stored in the RAM which is a memory unit incorporated in the CPU 50 or connected electrically to the CPU 50. The first adherence bias continues to be applied to the same recording material S, until the adherence bias is changed to a second adherence bias to be described later.

Then, the CPU 50 selects the optimum target value of the secondary transfer bias at the secondary transfer step, based on the result of measurement of the information on the electrical resistance of the recording material S1, conducted at the adherence position N, and on the conditions, such as the environment in which the image forming apparatus 100A is used, the type of sheet, and, in certain case, the resistance of the transfer member. Thus, in the present exemplary embodiment, there is selected a target bias voltage V (hereinafter called "target transfer voltage") to be supplied from the secondary transfer bias source 20, which is a constant-voltage source, to the secondary transfer roller 22 (for example +1.5 kV). Then, thus selected target transfer voltage V is applied to the secondary transfer roller 22 to execute the secondary transfer step.

Figure 6:
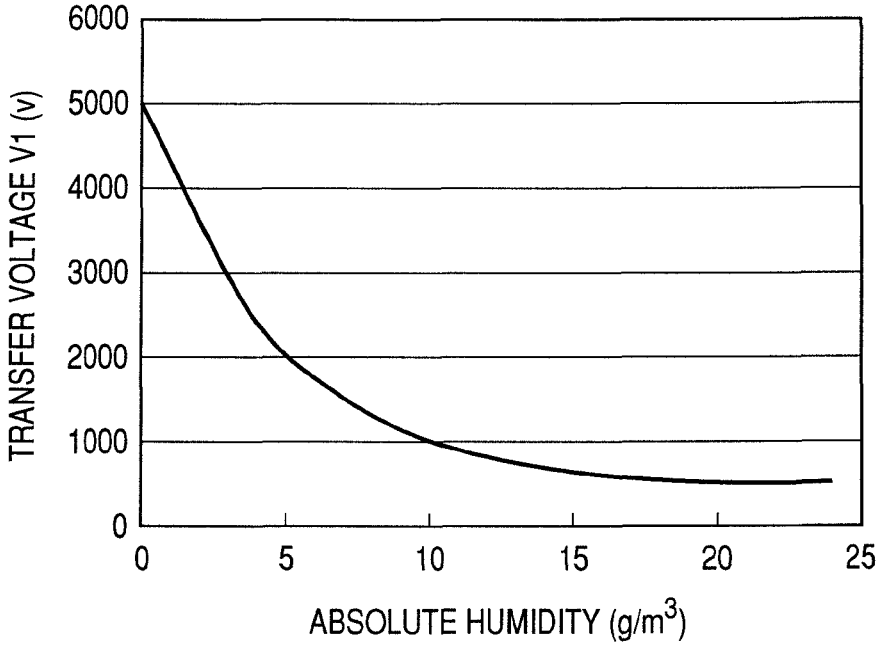
FIG. 6 is a graph illustrating an example of relationship between an absolute humidity in the environment and a transfer voltage V1.

In the CPU 50, the target transfer voltage V is calculated according to the following formula, from the voltage V1 determined from the relationship as illustrated in FIG. 6 and from the voltage V20 output at the current supply of 20 μA at the adherence position N. FIG. 6 is a transfer bias table set for each type of the recording material S and indicating the relationship between the absolute humidity and the voltage V1, determined from the detection result of the temperature-humidity sensor 55, and is stored in advance in a ROM, as a memory unit incorporated in the CPU 50 or connected electrically to the CPU 50:

$$V=V1+\kappa V20$$

Figure 7:
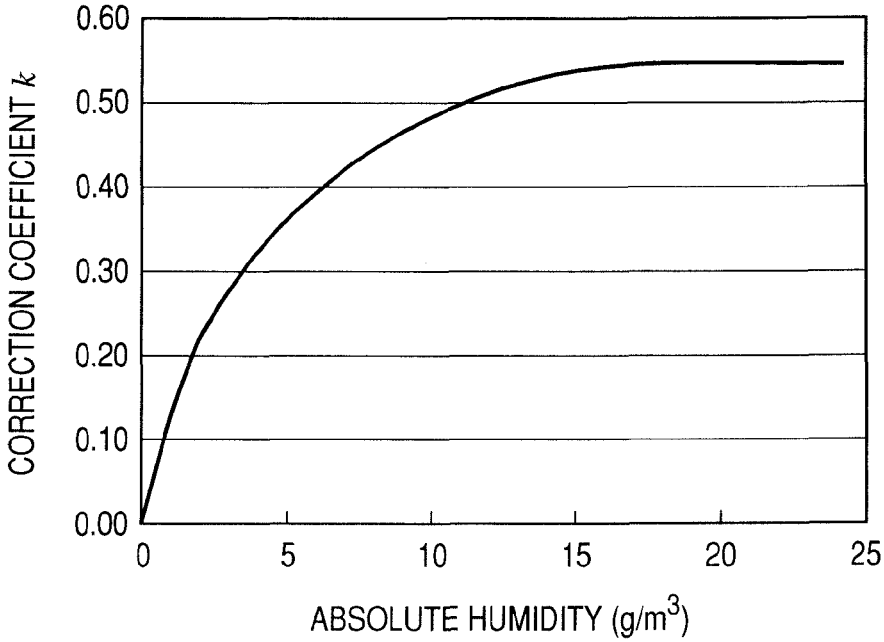
FIG. 7 is a graph illustrating an example of relationship between an absolute humidity in the environment and a resistant-detecting voltage correction coefficient κ.

Then, κ (correction coefficient for resistance-detected voltage) can be determined from a table indicating the relationship between the absolute humidity and κ as illustrated in FIG. 7. This table is stored in advance in a ROM, as a memory unit incorporated in the CPU 50 or connected electrically to the CPU 50.

Then, when the trailing end of the recording material S in the moving direction thereof reaches a position of a predetermined distance to the adherence roller 12, the CPU 50 switches the adherence bias from the first adherence bias to the second adherence bias. In the present exemplary embodiment, the afore-mentioned predetermined distance for switching the adherence bias was selected as 20 mm. Thus, when a position of the recording material S, at 20 mm from the trailing end in the moving direction thereof and toward the leading end in the moving direction, reaches the adherence position N, the adherence bias is switched from the first adherence bias to the second adherence bias. However, such example is not restrictive, and the point of switching the adherence bias is determined in view of not affecting the conveying performance of the recording material S and covering a range requiring prevention of an image defect. Therefore, so far as a sufficient adherence force is maintained for conveying the recording material S and a range generating an image defect can be covered, the predetermined range at the trailing end of the recording material S in the moving direction thereof is not limited to a range of a length of 20 mm in the moving direction. According to the investigation of the present inventors, this distance is advantageously 10 mm or more and 70 mm or less. In case of a distance shorter than this range, the effect of preventing an image defect, induced by a separating discharge when the recording material S is separated from the conveyor belt 21, may become indefinite. On the other hand, in case of a distance longer than this range, the effect of preventing an image defect is not improved significantly and the conveying performance of the recording material S may be deteriorated.

The second adherence bias to the predetermined range at the trailing end of the recording material S in the moving direction thereof is so selected, by the CPU 50, after the secondary transfer step, that the electric adherence force between the conveyor belt 21 and the recording material S becomes lower (for example 12 μA) with respect to the target transfer voltage V that has been selected as described above.

The recording material S, that is strongly positively charged by the positive adherence bias from the surface of the recording material S, is electrically adhered to the conveyor belt 21. The positively-charged recording material S is conveyed to the secondary transfer position T2, and receives the positive secondary transfer bias from the secondary transfer roller 22 at the rear side of the conveyor belt 21. Thus, the electric adherence force between the recording material S and the conveyor belt 21 is lowered. However, since the positive charge still remains, the electric adherence force between the recording material S and the conveyor belt 21 still exists. Therefore, at the separation from the conveyor belt 21, in the trailing end of the recording material S in the moving direction thereof where the conveying direction fluctuates, an image defect may be caused by a separating discharge. Therefore, within a predetermined range at the trailing end of the recording material S in the moving direction thereof, the adherence bias is switched to the second adherence bias so selected as to substantially cancel the electric adherence force between the recording material S and the conveyor belt 21 after the second transfer step.

According to the investigation by the present inventors, in order to sufficiently reduce the electric adherence force and to prevent an image defect caused by the separating discharge, the surface potential within the predetermined range at the trailing end of the recording material S in the moving direction thereof is preferably within a range of from 50 to 400 V. Below this range, the adherence force between the conveyor belt 21 and the recording material S is low and may deteriorate the stability of conveyance. On the other hand, above this range, an image defect by the separating discharge at the separation of the recording material S from the conveyor belt 21 may be facilitated.

Figure 8:
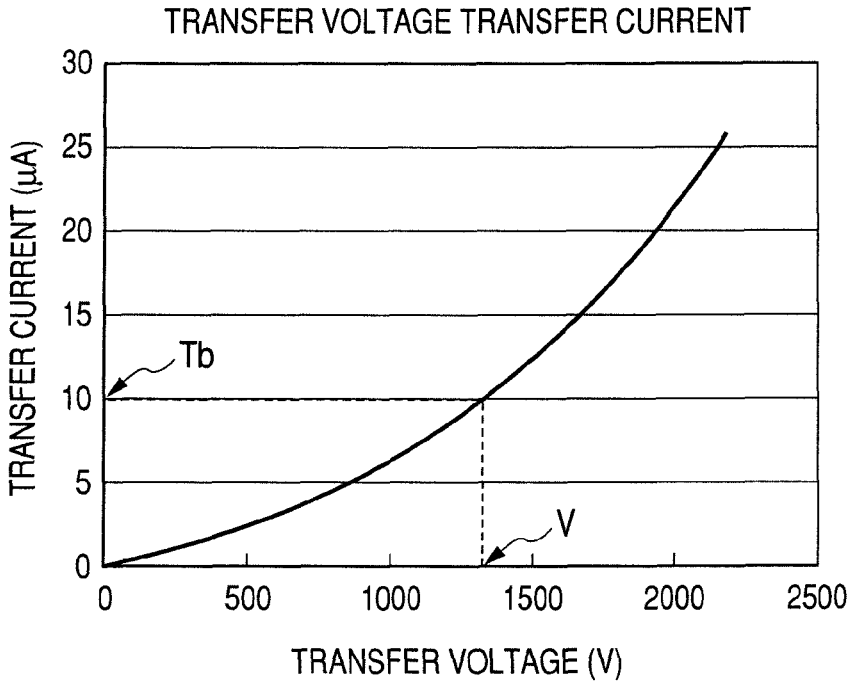
FIG. 8 is a graph illustrating an example of relationship between a transfer voltage and a transfer current.

The second adherence bias for the predetermined range in the trailing end of the recording material S in the moving direction thereof can be determined, for example, in the following manner. The transfer current Tb when the target transfer voltage V is applied can be predicted from a relation as illustrated in FIG. 8. In the present exemplary embodiment, the CPU 50 predicts the actual transfer current Tb at the secondary transfer step, from a table indicating such relation between the target transfer voltage V and the transfer current Tb. Then, the output current (adherence current) of the adherence bias source 13 is lowered in the absolute value, from the first adherence bias of 20 μA which is applied from the leading end of the recording material S in the moving direction thereof to the switching to the second adherence bias, to a value obtained by multiplying the predicted transfer current Tb by 1.2. For example, in the case of Tb=10 μA, the second adherence bias becomes 12 μA. The table indicating the relation of the target transfer voltage V and the transfer current Tb is stored in advance in a ROM, as a memory unit incorporated in the CPU 50 or connected electrically to the CPU 50.

However, since the transfer current is dependent on the thickness and resistance of the recording material S and on the environment, the calculation formula for determining the second adherence bias is not limited to that in the foregoing exemplary embodiment. Also, the second adherence bias for the trailing end of the recording material S in the moving direction thereof is not necessarily set lower, in the absolute value, than the first adherence bias for the leading end of the recording material S in the moving direction thereof, based on the relation between the first adherence bias for the leading end of the recording material S in the moving direction thereof and the transfer current, environment etc.

Figure 9:
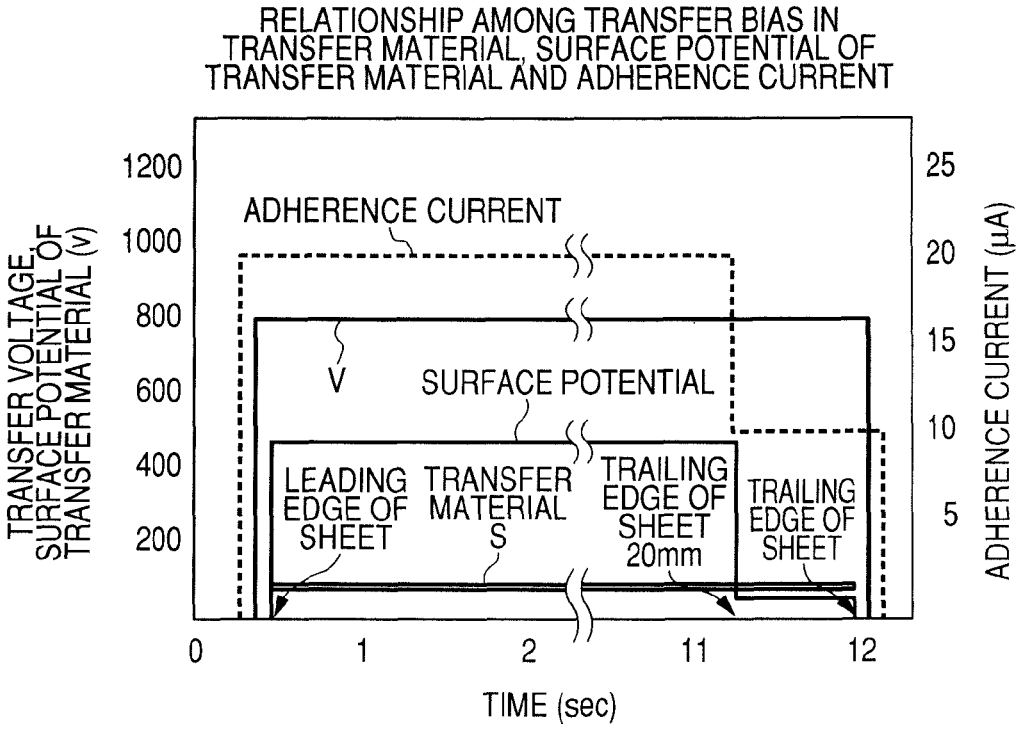
FIG. 9 is a schematic view illustrating an example of relationship among a transfer bias, a surface potential of the recording material and an adhering current.

FIG. 9 illustrates a change in the transfer bias and the adherence bias in the moving direction of the recording material S and a resulting surface potential of the recording material (for example paper) S. In the example illustrated in FIG. 9, the recording material S had a length of 297 mm in the moving direction (longitudinal size of A4 size), within which the adherence bias was switched at a position of 20 mm from the trailing end toward the leading end in the moving direction. The electric adherence force between the recording material S and the conveyor belt 21 can be represented by the surface potential of the recording material S. Therefore, the adherence force of the recording material S can be considered lower as the surface potential becomes lower.

As another method, the second adherence bias can be set, instead of predicting the transfer current with respect to the target transfer voltage V based on the relationship of the transfer voltage and the transfer current as illustrated in FIG. 8, by measuring the actual transfer current and utilizing the result of such measurement. More specifically, the transfer current flowing at the actual secondary transfer step is measured in the leading end portion of the recording material S in the moving direction thereof, and, based on such current, a second adherence bias for the trailing end portion of the recording material S in the moving direction thereof is so selected as to cancel the electric adherence force between the conveyor belt 21 and the recording material S.

Figure 5:
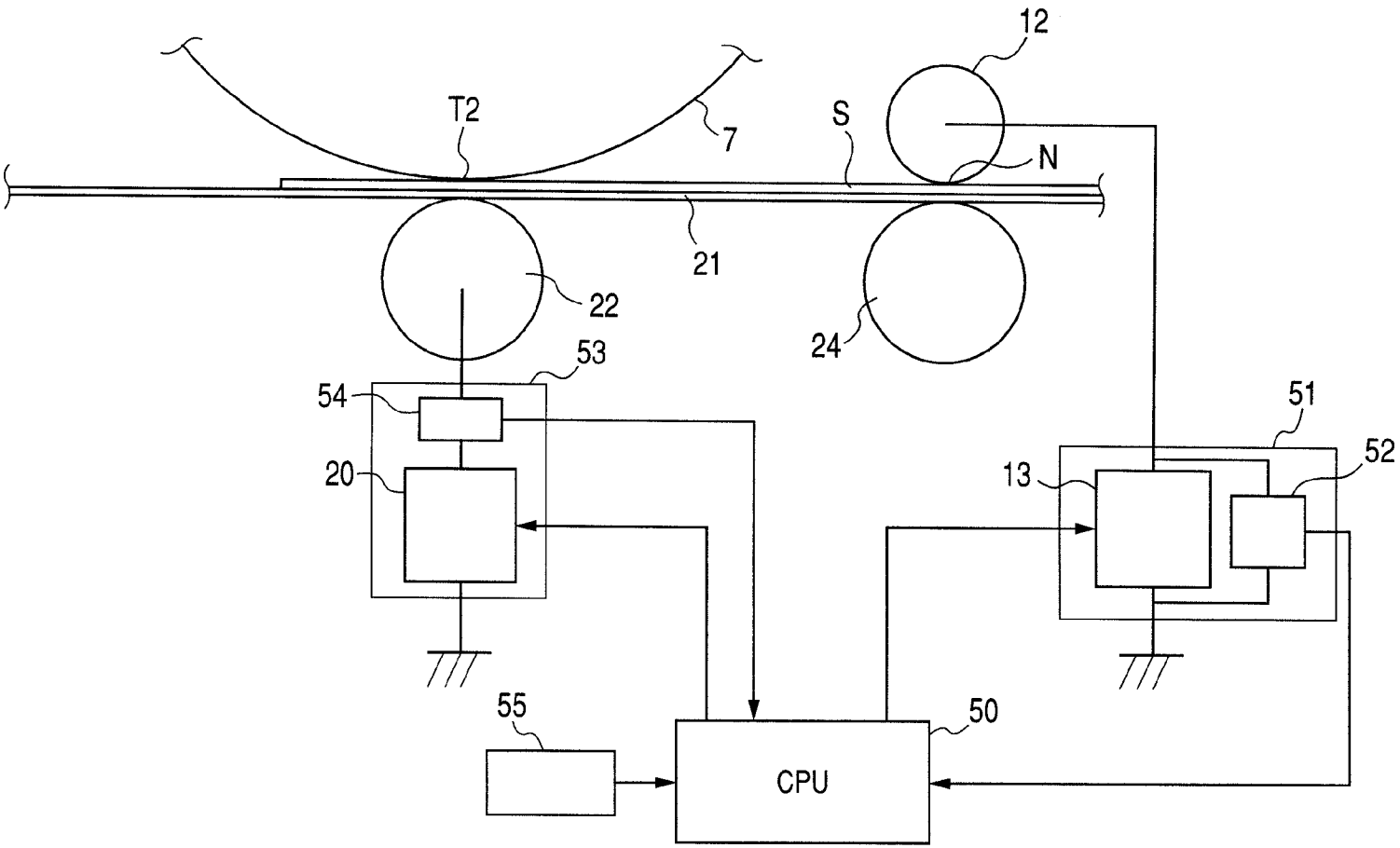
FIG. 5 is a block diagram illustrating another exemplary embodiment of a control in an adhering unit and a transfer unit.

In such case, as illustrated in FIG. 5, the secondary transfer bias source apparatus 53 is equipped with a secondary transfer bias source (bias output portion) 20 as a bias output unit for outputting the bias to the secondary transfer roller 22. Also the secondary transfer bias source apparatus 53 is equipped, as a measuring unit for measuring the output current when the secondary transfer bias source 20 outputs a bias particularly a constant-current bias, with a current measuring portion (ammeter) 54 for measuring the output current particularly when a constant voltage bias is output. The current measuring portion 54 measures a current flowing from the secondary transfer bias source 20 and through the secondary transfer roller 22. The current measuring portion 54 outputs an electrical signal, indicating the result of measurement, to the CPU 50 serving as a control unit. The CPU 50 determines the secondary adherence bias in the manner as described above, based on the signal indicating the measured result and supplied from the current measuring portion 54, namely based on the actual transfer current Tb at the secondary transfer operation.

More specifically, the current measuring portion 54 measures an output current of the secondary transfer bias source 20, when the secondary transfer bias is applied to a portion of the recording material S which extends from the leading end of the recording material S in the moving direction thereof to the position of switching to the second adherence bias and in which the first adherence bias has been applied. The secondary transfer bias in such state is applied according to the target value, typically determined from the information on the electrical resistance of the recording material S, detected by the application of the first adherence bias.

Such method of measuring the transfer current enables to detect the current flowing in the actual transfer step for each recording material S, thereby more efficiently preventing image defects.

Stated differently, the adherence bias output unit outputs, while the recording material passes the adherence portion (adherence position) from the leading end to the trailing end, adherence biases of at least two different values including the first adherence bias when the leading end passes the adherence portion and the second adherence bias when the leading end passes. In the case that the output voltage of the adherence bias output unit changes, as detected while the adherence bias output unit outputs a bias of a value of the first adherence bias under the constant-current control, the first adherence bias and the second adherence bias are different in the absolute value. Otherwise, in the case that the output current of the adherence bias output unit changes, as detected while the adherence bias output unit outputs a bias of a value of the first adherence bias under the constant-voltage control, the first adherence bias and the second adherence bias are different in the absolute value. This is principally because, while the first adherence bias does not change depending on the transfer bias, the second adherence bias changes according to the transfer bias. Furthermore, in other terms, in the case that the transfer current changes, as detected while a portion of the recording material, that has passed the adherence portion during the application of the first adherence bias, is passing the transfer portion and is subjected to the transfer operation, the first adherence bias and the second adherence bias are different in the absolute value.

The control of the adherence bias according to the present exemplary embodiment enables the reduction of the electric adherence force between the trailing end of the recording material S in the moving direction thereof and the conveyor belt 21, at the separation of the conveyor belt 21 and the trailing end of the recording material S in the moving direction thereof. Consequently, the trailing end of the recording material S in the moving direction thereof assumes a posture of conveyance as indicated by a symbol A in FIG. 2A, and an image defect caused by the separating discharge at the trailing end of the recording material S in the moving direction thereof, as schematically illustrated in FIG. 2C, can be prevented.

In the present exemplary embodiment described above, the bias applied to the adherence roller 12 is switched adaptive to the transfer bias, in a predetermined range at the trailing end of the recording material S in the moving direction thereof. It is thus rendered possible to reduce the adherence force between the conveyor belt 21 and the recording material S and to prevent image blurring caused by the separating discharge at the trailing end of the recording material S in the moving direction thereof. Therefore, image formation can be executed satisfactorily without deteriorating the transfer property and the conveying property at the image forming operation.

In particular, by changing the transfer bias based on the result of measurement of the information on the electrical resistance of the recording material S at the adherence position N and by changing the adherence bias according to the transfer bias, it is possible to obtain a satisfactory transfer property and conveying property and to prevent image defects in a simpler and more efficient construction. More preferably, image defects can be prevented more efficiently by measuring the actual transfer current.

Second Exemplary Embodiment

In the following, a second exemplary embodiment of the present invention will be described. In the first embodiment, the image forming apparatus 100A employs an intermediate transfer process, in which the toner image on the photosensitive member is once transferred onto the intermediate transfer member and the toner image on the intermediate transfer member is transferred onto the recording material, electrically adhered to the recording material bearing member. In contrast, the present exemplary embodiment adopts a direct transfer process, in which the toner image on the photosensitive member is directly transferred onto the recording material electrically adhered to the recording material bearing member.

Figure 3:
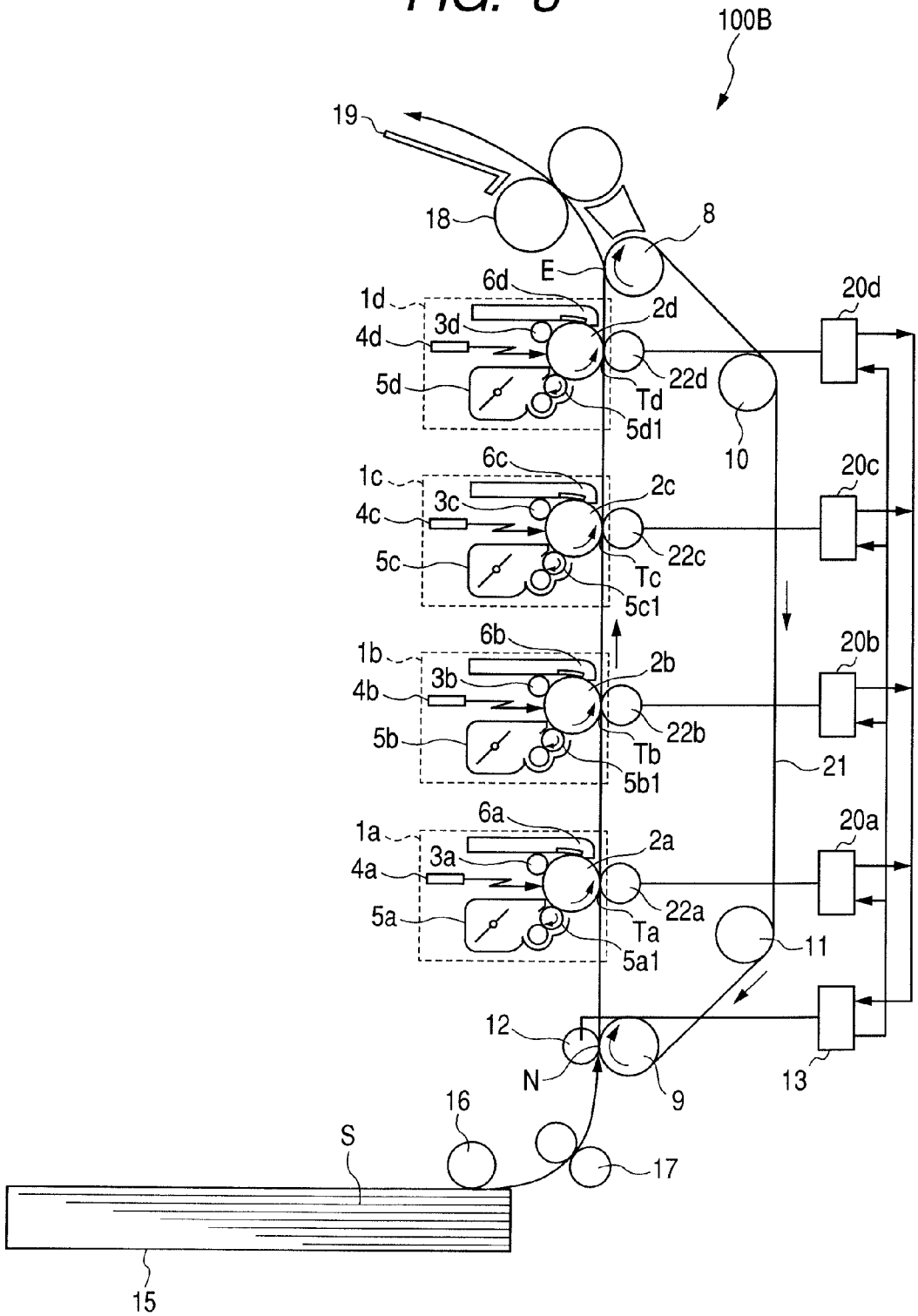
FIG. 3 is a schematic cross-sectional view of an image forming apparatus in another exemplary embodiment of the present invention.

FIG. 3 schematically illustrates the construction of an image forming apparatus 100B of the present exemplary embodiment. In the image forming apparatus 100B illustrated in FIG. 3, elements having functions or constructions similar or equivalent to those of the elements in the image forming apparatus 100A illustrated in FIG. 1 will be represented by the same reference numerals and characters and will be omitted from the detailed description.

The image forming apparatus 100B of the present exemplary embodiment include first to fourth process stations 1*a*-1*d*, similar to those in the image forming apparatus 100A of the first exemplary embodiment, arranged substantially linearly along a substantially vertical direction. The construction of each of the process stations 1*a*-1*d* is similar to that in the first exemplary embodiment.

In the image forming apparatus 100B of the present exemplary embodiment, a conveyor belt 21, formed by an endless belt and serving as a recording material bearing member (recording material bearing/conveying member) for bearing and conveying a recording material S, is disposed along the process stations 1*a*-1*d*. The conveyor belt 21 is supported under tension by, as a plurality of support members, a conveyor belt driving roller 8, an idler roller 9, and tension rollers 10, 11. By a rotary driving power transmitted from an unillustrated drive unit (driving source) to the conveyor belt driving roller 8, the conveyor belt 21 is rotated (circulatory displacement) in a direction indicated by an arrow. The conveyor belt 21 is so positioned as to be in contact with the photosensitive drums 2*a*-2*d* of the process stations 1*a*-1*d*, and conveys the recording material S, supported thereon, so as to be in contact in succession with the photosensitive drums 2*a*-2*d* of the process stations 1*a*-1*d*.

On the internal surface side of the conveyor belt 21, in positions respectively opposed to the photosensitive drums 2*a*-2*d*, disposed are transfer rollers 22*a*-22*d* which are rotary members serving as transfer members. The transfer rollers 22*a*-22*d* are pressed respectively to the photosensitive drums 2*a*-2*d* across the conveyor belt 21. Thus, nips (transfer nips) are formed in transfer portions Ta-Td, which are contact portions between the conveyor belt 21 and the photosensitive drums 2*a*-2*d*. In the present exemplary embodiment, the transfer rollers 22*a*-22*d* are independently connected to transfer bias sources 20*a*-20*d*, which are constant voltage sources serving as bias output units. In the present exemplary embodiment, at a transfer step, transfer biases, that are output from the transfer bias sources 20*a*-20*d*, are controlled at a constant voltage and have a polarity opposite to the normal charging polarity of the toner, are applied to the transfer rollers 22*a*-22*d*. Thus, in each of the transfer portions Ta-Td, an electric field is formed in such a direction that the toner charged in the normal charging polarity moves from the photosensitive drums 2*a*-2*d* to the side of the conveyor belt 21. Therefore, by the application of the transfer bias to the transfer rollers 22*a*-2*d*, the toner images of the respective colors on the photosensitive drums 2*a*-2*d* are transferred onto the recording material S borne on the conveyor belt 21.

On the surface of the conveyor belt 21, at the upstream side of the first process station 1*a* in the conveying direction of the recording material S, an adherence roller 12, which is a rotary member serving as an adherence member, is contacted in a state opposed to the idler roller 9. Thus, a nip (adherence nip) is formed in an adherence position N which is a contact portion of the adherence roller 12 and the conveyor belt 21. The adherence roller 12 pinches the recording material S, passing the adherence position N, in cooperation with the conveyor belt 21. In the present exemplary embodiment, the adherence roller 12 is connected to an adherence bias source 13 which is a constant current power source serving as a bias output unit. Also in the present exemplary embodiment, the idler roller 9 is electrically grounded. In the present exemplary embodiment, at an adherence step of adhering the recording material S to the conveyor belt 21, an adherence bias (constant current bias), that is output from the adherence bias source 13, is controlled at a constant current and has a polarity the same as that of the transfer bias (namely opposite to the normal charging polarity of the toner) is applied. Thus, the recording material S is charged by an electric field formed between the adherence roller 12 and the conveyor belt 21. In this manner the recording material S is conveyed, under electrical adherence, by the conveyor belt 21.

The present exemplary embodiment includes, corresponding to the secondary transfer step in the first embodiment of the toner image by the secondary transfer roller 22 onto the recording material S on the conveyor belt 21, primary transfer steps by the plural transfer rollers 22*a*-22*d* from the photosensitive drums 2*a*-2*d* onto the recording material S on the conveyor belt 21. The construction and function of the secondary transfer roller 22 and the secondary transfer power source 20 described in the first embodiment may be applied in the substantially same manner to the present exemplary embodiment, by understanding the secondary transfer step as the transfer step.

The recording material S is stored in a stacked state in a feed unit 15, provided in a lower part of the image forming apparatus 100B, as illustrated in FIG. 3, and is separated and fed one-by-one by a feed roller 16 constituting a feeding unit, and conveyed to registration rollers 17 in pair. The paired registration rollers 17 advance the recording material S onto the conveyor belt 21, in synchronization with images on the photosensitive drums 2*a*-2*d*. For example, in case of a full-color image formation, the toner images formed on the photosensitive drums 2*a*-2*d* of the process stations 1*a*-1*d* in the same manner as in the first exemplary embodiment are transferred, in the transfer portions Ta-Td, in succession and in superposition onto the recording material S borne on the conveyor belt 21. The recording material S is separated from the conveyor belt 21 at a separating portion E which is positioned above a drive roller 8 at the downstream side of the fourth process station id in the conveying direction of the recording material S. Then, the recording material S, after an image fixation by applications of heat and pressure in the fixing device 18 as a fixing unit, is discharged to a discharge tray 19, which is exposed at the exterior of the image forming apparatus 100B.

In the image forming apparatus 100B of the afore-mentioned construction, the recording material S can be firmly adhered to the conveyor belt 21 and the conveying performance can be improved by applying an adherence bias (for example 20 μA) to the adherence roller 12.

However, as described in the first exemplary embodiment, in the recording material S electrically adhered firmly to the conveyor belt 21, the trailing end thereof in the moving direction assumes, at the separation from the conveyor belt 21, a state similar to that indicated by a symbol B in FIG. 2A. Also a separating discharge, similar to that indicated by a symbol C in FIG. 2A, occurs between the surface of the conveyor belt 21 and the rear surface of the recording material S. Therefore, the transferred image may cause an image blur D as schematically illustrated in FIG. 2B.

In the present exemplary embodiment, the recording material S conveyed to the adherence position N, where a nip is formed between the conveyor belt 21 and the adherence roller 12, is sufficiently adhered to the conveyor belt 21 by the adherence bias, supplied from the adherence bias source 13, which is a constant-current source, to the adherence roller 12. The construction of the adherence bias source 13 for outputting a bias to the adherence roller 12 of the present exemplary embodiment is as described in the first exemplary embodiment with reference to FIG. 4. The recording material S, thus sufficiently adhered to the conveyor belt 21, is conveyed to the transfer portions Ta-Td. The adherence bias (the first adherence bias) in this state has a current amount sufficient for preventing an aberration in color and a lifting of the recording material S from the conveyor belt 21, and enabling to measure the information on the electrical resistance of the recording material S, from the voltage and the current at the supply of such adherence bias. Such a current amount is, for example, 20 μA. Then, an electrical signal indicating the measured result of the output current of the adherence bias source 13 is supplied to the CPU 50, and is stored in the RAM which is a memory unit incorporated in the CPU 50 or connected electrically to the CPU 50. This first adherence bias continues to be applied to the same recording material S, until the adherence bias is changed to a second adherence bias to be described later.

Then, the CPU 50 selects the optimum target value of the transfer bias at the transfer step, based on the result of measurement of the information on the electrical resistance of the recording material S, conducted at the adherence position N, and on the conditions such as the environment in which the image forming apparatus 100B is used, the type of sheet, and, in certain case, the resistance of the transfer member. Thus, in the present exemplary embodiment, there is selected a target transfer voltage V (for example +1.5 kV) to be supplied from the transfer bias sources 20*a*-20*d*, which are constant-voltage sources, to the transfer rollers 22*a*-22*d*. Then, thus selected target transfer voltage V is applied to the transfer rollers 22*a*-22*d* to execute the transfer step at the transfer portions Ta-Td.

The target transfer voltage V may be the same or different for the transfer portions Ta-Td corresponding to the process stations 1*a*-1*d*. The CPU 50 may set the target transfer voltage V at a same value or at different values for the transfer portions Ta-Td, based on the result of measurement of the information on the electrical resistance of the recording material S, at the adherence position N. In the present exemplary embodiment, the target transfer voltage V is assumed to be same for all the transfer portions Ta-Td.

In the CPU 50, the target transfer voltage V is calculated according to the following formula, from the voltage V1 determined from the relationship as illustrated in FIG. 6 and from the voltage V20 output at the current supply of 20 μA at the adherence position N. FIG. 6 is a transfer bias table set for each type of the recording material S and indicating the relationship between the absolute humidity and the voltage V1, determined from the detection result of the temperature-humidity sensor 55, and is stored in advance in a ROM, as a memory unit incorporated in the CPU 50 or connected electrically to the CPU 50:

$$V = V1 + \kappa V20$$

wherein κ (correction coefficient for resistance-detected voltage) can be determined from a table indicating the relationship between the absolute humidity and κ as illustrated in FIG. 7. This table is stored in advance in a ROM, as a memory unit incorporated in the CPU 50 or connected electrically to the CPU 50.

Then, when the trailing end of the recording material S in the moving direction thereof reaches a position of a predetermined distance to the adherence roller 12, the CPU 50 switches the adherence bias from the first adherence bias to the second adherence bias. In the present exemplary embodiment, the afore-mentioned predetermined distance for switching the adherence bias was selected as 20 mm. Thus, when a position of the recording material S, at 20 mm from the trailing end in the moving direction thereof and toward the leading end in the moving direction, reaches the adherence position N, the adherence bias is switched from the first adherence bias to the second adherence bias. However, as described in the first exemplary embodiment, the point of switching the adherence bias is determined in view of not affecting the conveying performance of the recording material S and covering a range requiring prevention of an image defect. Therefore, so far as a sufficient adherence force is maintained for conveying the recording material S and a range generating an image defect can be covered, the predetermined range at the trailing end of the recording material S in the moving direction thereof is not limited to a range of a length of 20 mm in the moving direction.

The second adherence bias to the predetermined range at the trailing end of the recording material S in the moving direction thereof is so selected, by the CPU 50, that the electric adherence force between the conveyor belt 21 and the recording material S becomes lower after the four transfer steps with respect to the target transfer voltage V that has been selected as described above. In such a case, the second adherence bias is for example 48 μA.

The recording material S, that is strongly positively charged by the positive adherence bias from the surface of the recording material S, is electrically adhered to the conveyor belt 21. The positively charged recording material S is conveyed to the transfer portions Ta-Td, and receives the positive transfer bias four times from the transfer rollers 22*a*-22*d* at the rear side of the conveyor belt 21. Thus, the recording material S is strongly charged negatively and is firmly adhered electrically to the conveyor belt 21, and, at the separation from the conveyor belt 21, in the trailing end of the recording material S in the moving direction thereof where the conveying direction fluctuates, an image defect may be caused by a separating discharge. Therefore, within a predetermined range at the trailing end of the recording material S in the moving direction thereof, the adherence bias is switched to the second adherence bias so selected as to substantially cancel the electric adherence force between the recording material S and the conveyor belt 21 after the transfer step.

The second adherence bias for the predetermined range in the trailing end of the recording material S in the moving direction thereof can be determined in the following manner, as in the first exemplary embodiment. The transfer current Tb when the target transfer voltage V is applied can be predicted from a relation as illustrated in FIG. 8. In the present exemplary embodiment, the CPU 50 predicts the actual transfer current Tb at a transfer step, from a table indicating the relation between the target transfer voltage V and the transfer current Tb. Then, the output current (adherence current) of the adherence bias source 13 is increased in the absolute value, from the first adherence bias of 20 μA which is applied from the leading end of the recording material S in the moving direction thereof to the switching to the second adherence bias, to a value obtained by multiplying the predicted transfer current Tb by 4.8. For example, in the case of Tb=10 μA, the second adherence bias becomes 48 μA. The table indicating the relation of the target transfer voltage V and the transfer current Tb is stored in advance in a ROM, as a memory unit incorporated in the CPU 50 or connected electrically to the CPU 50.

However, since the transfer current is dependent on the thickness and resistance of the recording material S and on the environment, the calculation formula for determining the second adherence bias is not limited to that of the present exemplary embodiment. Also the second adherence bias for the trailing end of the recording material S in the moving direction thereof is not necessarily set higher, in the absolute value, than the first adherence bias for the leading end of the recording material S in the moving direction thereof, based on the relation between the first adherence bias for the leading end of the recording material S in the moving direction thereof and the transfer current, environment etc. Also, in the foregoing description, the second adherence bias for the recording material S to be subjected to a plurality of transfer steps is determined based on the result of prediction of the transfer current in a single transfer step, but it may also be based on the result of prediction of the transfer currents in all (or some) of the a plurality of transfer steps. Also in the foregoing description, the transfer step is assumed to be conducted four times for example in case of a full-color image formation, but the value of the second adherence bias may be changed according to the number of transfer operations of the toner onto the recording material S for example in a monochromatic image formation or a multi-color image formation.

As another method, the second adherence bias can be set, instead of predicting the transfer current with respect to the target transfer voltage V based on the relationship of the transfer voltage and the transfer current as illustrated in FIG. 8, according to the result of measurement of the actual transfer current as described in the first exemplary embodiment. More specifically, the transfer current flowing at the actual transfer step is measured in the leading end portion of the recording material S in the moving direction thereof, and, based on such current, a second adherence bias for the trailing end portion of the recording material S in the moving direction thereof is so selected as to cancel the electric adherence force between the conveyor belt 21 and the recording material S.

In such a case, transfer bias source 20*a* or the like, that outputs the bias to at least one of the transfer rollers 22*a*-22*d*, preferably to the transfer rollers 2*a* for the first process station 1*a*, may be constructed in the following manner. The construction may be made substantially the same as, as described in the first exemplary embodiment with reference to FIG. 5, that of the secondary transfer bias source for outputting the bias to the secondary transfer roller. In the description of the first exemplary embodiment, by understanding the part relating to the secondary transfer step as relating to the transfer step, it is possible to apply the substantially all the construction to the present exemplary embodiment. By measuring the transfer current in at least the first process station 1*a*, it is possible to more securely determine the second adherence bias until the predetermined range at the trailing end of the recording material S in the moving direction thereof reaches the adherence position N.

The second adherence bias for the recording material S to be subjected to a plurality of transfer steps may be determined, based on the result of measurement of the transfer current in a transfer step, or based on the result of measurement of the transfer current in each of the a plurality of transfer steps. This is similar to the afore-mentioned case of predicting the transfer current. Also the second adherence bias may be changed depending on the number of toner transfers to the recording material S.

Such method of measuring the transfer current enables detecting the current flowing in the actual transfer step for each recording material S, thereby preventing image defects more efficiently.

The control of the adherence bias according to the present exemplary embodiment enables reducing the electric adherence force between the trailing end of the recording material S in the moving direction thereof and the conveyor belt 21, at the separation of the conveyor belt 21 and the trailing end of the recording material S in the moving direction thereof. Consequently, the trailing end of the recording material S in the moving direction thereof assumes a posture of conveyance as indicated by a symbol A in FIG. 2A, and an image defect caused by the separating discharge at the trailing end of the recording material S in the moving direction thereof, as schematically illustrated in FIG. 2C, can be prevented.

As described above, the present exemplary embodiment enables, also in the image forming apparatus 100B of direct transfer process, obtaining effects similar to those of the image forming apparatus 100A of intermediate transfer process of the first exemplary embodiment.

Third Exemplary Embodiment

The present exemplary embodiment describes an image forming apparatus having a mode of forming an image extending even to an edge of the recording material. In the following, a description will be made based on the image forming apparatus described in the exemplary embodiment 1.

The image forming apparatus of the present exemplary embodiment has an normal print mode in which a margin is formed on the recording material, and a mode of printing to the edge of the recording material (hereinafter called "print-to-edge mode"). The normal print mode means a mode of forming a margin over the entire periphery of the recording material S, and the print-to-edge mode means a mode of not forming the margin in any of the edges of the recording material.

In the normal print mode, a toner image somewhat smaller than the size of the recording material S is formed on the intermediate transfer belt 7, and such toner image is transferred, at the secondary transfer position T2, so as to leave a margin on the peripheral edges of the recording material S. On the other hand, in the print-to-edge mode, the toner image formed on the intermediate transfer belt 7 is transferred, at the secondary transfer position T2, so as to overflow from the recording material S. In this manner, there is formed a portion without the margin. In the print-to-edge mode, certain ways of execution are conceivable, such as a method of forming a toner image larger than the recording material S on the intermediate transfer belt 7 and transferring the toner image onto the recording material S positioned under the secondary transfer position T2 in such a manner that the recording material S is contained within the toner image, and a method of regulating the timing of conveyance of the recording material S in such a manner that the toner image on the intermediate transfer belt 7 overflows from the edge of the recording material S at the secondary transfer position T2.

The afore-mentioned image blur in the toner image at the separation of the recording material S becomes most severe at the final stage of separation of the recording material from the conveyor belt 21. On the recording material S, it appears most severely at the trailing end side of the recording material S in the conveying direction thereof. In the normal print mode, the trailing end portion, where the toner image is significantly blurred by the separating discharge in the vicinity of the trailing edge of the sheet, is formed as a margin without the toner image. On the other hand, in the print-to-edge mode, the toner image may be formed to the trailing edge of the recording material S. Then, in the case that the toner image is formed to the trailing edge of the recording material, the blur in the toner image by the separating discharge appears more conspicuously.

In the present exemplary embodiment, therefore, the control is changed between the normal print mode and the print-to-edge mode. As the image blur at the trailing end of the recording material is more severe in the print-to-edge mode than in the normal print mode, the switching of the adherence bias (switching from the first adherence bias to the second adherence bias while the single recording material passes the position opposed to the adherence member), as described in the first exemplary embodiment, is executed only in the print-to-edge mode. On the other hand, the switching of the adherence bias is not executed in the normal print mode, since the switching of the adherence bias has not a little influence on the secondary transfer.

The present invention has been described by specific exemplary embodiments, but it is to be understood that the present invention is not limited to such embodiments.

For example, the constant-current source or the constant-voltage source, described in the foregoing exemplary embodiments, may apply a DC voltage and an AC voltage in superposition. Also embodiments are possible having, instead of the constant-current source or the constant-voltage source in the foregoing exemplary embodiment, a constant-voltage source or a constant-current source respectively. Also in the foregoing exemplary embodiments, the process stations are arranged substantially linearly along a substantially vertical direction, but these may also be arranged substantially linearly along a substantially horizontal direction. Also in the foregoing exemplary embodiments, the image forming apparatus includes a plurality of process stations, but the present invention may be applied with similar effects to a monochromatic image forming apparatus having only one process station.

Also, for example in the image forming apparatus 100B of direct transfer process described in the second exemplary embodiment 2, as the detection unit for detecting the information on the electrical resistance of the recording material S, the transfer roller, which is a transfer member, may be employed instead of the adherence roller. For example, in a state where a non-image area at the leading end of the recording material S is present in the transfer portion Ta corresponding to the first process station 1*a* as the upstream side transfer portion among the plurality of transfer portions, a detecting bias under a constant-current control or a constant-voltage control is output to the transfer roller, and the output voltage or the output current is measured in such state whereby the information on the electrical resistance of the recording material S can be measured prior to the transfer step. Thus, the target value of the transfer bias can be determined based on the result of such measurement, and the second adherence bias can be determined from the target value of the transfer bias. The transfer bias source in such case may be substantially the same as the adherence bias source in the foregoing exemplary embodiments. Furthermore, as still another method, a detecting unit may be provided separately from the adherence roller or the transfer roller.

Also, for example in case of image formation continuously on plural recording materials, the determination of target value of the transfer bias and the change thereof may be executed for every plural recording materials, instead of for every single recording material.

The determination of the target value of the transfer bias, based on the information on the electrical resistance of the recording material, enables obtaining a more appropriate transfer bias. However, such method is not restrictive, and the target value of the transfer bias may be determined solely on other conditions such as the type of sheet and the environment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-317849, filed Nov. 24, 2006, which is hereby incorporated by reference herein in its entirety.

What is claimed is:

1. An image forming apparatus comprising:

an image bearing member for bearing a toner image;

a transfer member for electrically transferring the toner image from said image bearing member to a recording material at a transfer position;

a recording material conveying member for bearing and conveying the recording material through the transfer position;

an adhering member for charging the recording material at an adhering position upstream of the transfer position thereby electrically adhering the recording material to said recording material conveying member;

a first power supply portion for supplying the adhering member with a voltage;

a second power supply portion for supplying said transfer member with a voltage; and a controller for controlling the output of said first power supply portion, wherein, when a recording material is positioned astride the adhering position and the transfer position, said controller switches the output of said first power supply portion from a first output to a second output, and sets the second output based on a voltage-current relationship of the output of said second power supply portion.

2. An image forming apparatus according to claim 1, wherein the second output is set based on a resistance of the recording material as determined from a voltage-current relationship of the output of the second power supply portion.

3. An image forming apparatus according to claim 1, wherein said second power supply portion sets an output applied to said transfer member based on a resistance of the recording material as determined from a voltage and a current of the first output.

4. An image forming apparatus according to claim 1, wherein said controller sets the second output by detecting an output current of the first power supply portion in a condition where said first power supply portion applies a predetermined voltage to said adhering member.

5. An image forming apparatus according to claim 1, wherein said controller sets the second output by detecting an output voltage of said first power supply portion in a condition where said first power supply portion applies a predetermined current to said adhering member.

6. An image forming apparatus according to claim 1, wherein an electric field formed at the transfer position and an electric field formed at the adhering position are formed in directions opposite to each other.

7. An image forming apparatus according to claim 6, wherein when the recording material in the transfer position has a high electrical resistance, the second output is set higher, and when the recording material in the transfer position has a low electrical resistance, the second output is set lower.

8. An image forming apparatus according to claim 1, wherein said apparatus includes a mode of not transferring the toner image to an edge of the recording material thereby forming a margin on a trailing end edge of the recording material, and a mode of transferring the toner image, formed on said image bearing member, to the trailing end edge of the recording material.

9. An image forming apparatus comprising:

an image bearing member for bearing a toner image;

a transfer member for electrically transferring the toner image from said image bearing member to a recording material at a transfer position;

a recording material conveying member for bearing the recording material from an upstream side to a downstream side of the transfer position and conveying the recording material through the transfer position;

an adhering member for charging the recording material at an adhering position upstream of the transfer position thereby electrically adhering the recording material to said recording material conveying member;

a first power supply portion for supplying said adhering member with a voltage;

a controller for controlling the output of said first power supply portion, a first mode of not forming the toner image on an edge of the recording material thereby forming a margin on a trailing end edge of the recording material; and a second mode of forming the toner image extending to the trailing end edge of the recording material, wherein, when the second mode is executed, said controller switches the output of said first power supply portion from a first output to a second output different from the first output, while the recording material passes said adhering position.

10. An image forming apparatus according to claim 9, wherein, when the first mode is executed, said controller maintains a constant output of said first power supply portion while an entire area of the recording material passes said adhering member.

11. An image forming apparatus according to claim 9, further comprising:

a second power supply portion for supplying the transfer member with a voltage, wherein, when a recording material is positioned astride the adhering position and the transfer position, said controller switches the output of said first power supply portion from a first output to a second output, and sets the second output based on a voltage-current relationship of the output of said second power supply portion.

12. An image forming apparatus according to claim 11, wherein the second output is set based on a resistance of the recording material as determined from a voltage-current relationship of the output of the second power supply portion.

13. An image forming apparatus according to claim 11, wherein said second power supply portion sets an output applied to said transfer member based on a resistance of the recording material as determined from a voltage and a current of the first output.

14. An image forming apparatus according to claim 11, wherein said controller sets the second output by detecting an output current of said first power supply portion in a condition where said first power supply portion applies a predetermined voltage to the adhering member.

15. An image forming apparatus according to claim 11, wherein said controller sets the second output by detecting an output voltage of said first power supply portion in a condition where said first power supply portion applies a predetermined current to the adhering member.

16. An image forming apparatus according to claim 11, wherein an electric field formed at the transfer position and an electric field formed at the adhering position are formed in directions opposite to each other.

17. An image forming apparatus according to claim 16, wherein when the recording material in the transfer position has a high electrical resistance, the second output is set higher, and when the recording material in the transfer position has a low electrical resistance the second output is set lower.

* * * * *